United States Patent [19]

Terry

[11] 3,952,802

[45] Apr. 27, 1976

[54] METHOD AND APPARATUS FOR IN SITU GASIFICATION OF COAL AND THE COMMERCIAL PRODUCTS DERIVED THEREFROM

[75] Inventor: Ruel C. Terry, Denver, Colo.

[73] Assignee: In Situ Technology, Inc., Denver, Colo.

[22] Filed: Dec. 11, 1974

[21] Appl. No.: 531,453

[52] U.S. Cl. ..... 166/262; 166/57; 166/261; 166/302; 165/45

[51] Int. Cl.[2] ..... E21B 43/24

[58] Field of Search ..... 166/262, 280, 256–261, 166/302, 303, 57; 299/3, 4, 5

[56] References Cited

UNITED STATES PATENTS

| | | | |
|---|---|---|---|
| 2,481,051 | 9/1949 | Uren | 166/302 UX |
| 2,670,047 | 2/1954 | Mayes et al. | 166/262 |
| 2,985,238 | 5/1961 | Dixon | 166/262 |
| 3,010,513 | 11/1961 | Gerner | 166/262 X |
| 3,013,609 | 12/1961 | Ten Brink | 166/302 X |
| 3,106,246 | 10/1963 | Prentiss | 166/262 X |
| 3,160,208 | 12/1964 | Jorda | 166/57 |
| 3,250,327 | 5/1966 | Crider | 166/262 X |
| 3,373,805 | 3/1968 | Boberg et al. | 166/57 X |
| 3,498,381 | 3/1970 | Earlougher, Jr. | 166/303 |
| 3,796,265 | 3/1974 | Eickmeier | 166/303 |

*Primary Examiner*—Stephen J. Novosad
*Attorney, Agent, or Firm*—Burton, Crandell & Polumbus

[57] ABSTRACT

The process of the invention includes the concept of igniting a coal formation in situ with hot granular material and subsequently allowing the material to flow into the burning coal formation to serve as a propping agent in the event of a cave-in. Gasifying agents are injected into the formation in an alternating pattern to alternately oxidize and reduce the coal environment to optimize the BTU content of the recovered gas. Further, a heat receptive liquid is circulated through the casing in the well connecting the coal formation to the surface to strip the sensible heat from the produced gases so that the heat can be used for useful purposes apart from the produced gas.

The apparatus of the invention includes a casing in the well bore which has a plurality of vertically spaced dividers each having a passage therethrough so that a heat receptive fluid can be passed between dividers in a vertical descent through the casing and during such descent strip sensible heat from the produced gas before being brought back to the surface. Hot granular material is placed in the well in contact with the coal formation to ignite the formation and to flow into cavities formed in the formation during the burning thereof to serve as a propping agent.

25 Claims, 5 Drawing Figures

METHOD AND APPARATUS FOR IN SITU GASIFICATION OF COAL AND THE COMMERCIAL PRODUCTS DERIVED THEREFROM

BACKGROUND OF THE INVENTION

The present invention relates generally to coal gasification systems and more particularly to an in situ coal gasification system wherein a gas with optimum BTU content can be recovered.

There are many deposits in the coal regions of the world that are favorably situated, but are commercially unminable due to the high sulfur content of the coal, the deposit itself is a prolific aquifer, the deposit is gas prone, or the like.

While high sulfur content of the coal presents no unusual hazards to manpower underground, burning of the coal above ground results in unacceptable pollution of the atmosphere due to emissions of sulfur dioxide ($SO_2$), sulfur trioxide ($SO_3$) and gaseous sulfuric acid. Removal of the sulfur from raw coal is a costly undertaking, the costs generally exceeding the market value of the residual coal. In the coal deposits where the deposit itself is an aquifer, dewatering is a costly and continuing undertaking that is compounded by disposal problems of contaminated water. Coal deposits that are gas prone contain ever present perils to manpower underground such as the hazards of fire and explosion and unsafe breathing atmospheres.

In burning coal above ground as a fuel, one attempts to attain a maximum practical calorific value from the coal. In so doing the hydrogen content is burned to water vapor and the carbon content is burned to carbon dioxide ($CO_2$). Reasonable attempts are made to prevent the escape of free hydrogen and carbon monoxide (CO) into the flue gases because hydrogen has a heat content of 320 BTU per standard cubic foot and carbon monoxide has a heat content of 315 BTU per standard cubic foot. Escape of these gases unburned represents a significant loss in efficiency, and the environmental impact of releasing large quantities of carbon monoxide into the atmosphere presents unacceptable hazards. Thus, the hearth, furnace, combustion chamber and the like for coal are kept in an oxidizing environment, so that all gases will be essentially fully oxidized before being discharged into the atmosphere.

All coals contain sulfur, varying from less than one percent to ten percent or higher. When coal is burned in an oxidizing environment its sulfur content is largely burned to sulfur dioxide which is a reasonably stable compound. Sulfur dioxide, however, may be further oxidized in the presence of a catalyst, for example, iron into sulfur trioxide which is an unstable compound. Most combustion chambers have iron components, which serve as a mild catalyst to generate sulfur trioxide in the exit gases. In the same exit gas there is water vapor resulting from the combustion of hydrogen. Unstable sulfur trioxide readily combines with water vapor to form gaseous sulfuric acid ($H_2SO_4$) in the exit gases. These sulfur products although representing a small percentage of the exit gases, produce significant dileterious affects on animal and plant life when introduced into the atmosphere. Even with small percentages, the volumes of sulfur products can be enormous. It is for these reasons that governmental agencies have increasingly placed more stringent requirements on maximum allowable sulfur levels in fuels.

Repeated attempts have been made to develop suitable means to remove sulfur dioxide and sulfur trioxide from stack gases. A satisfactory method has not been found to reduce the sulfur content of raw coal to desired levels. To meet governmental imposed environmental standards, the coal industry has been forced to go to deposits with lower sulfur content, and to bypass vast deposits of higher sulphur coals. In the United States, the low sulfur coals tend to be at great distances from population centers and the points of use for the coal. Further, low sulfur coals tend to be high in moisture and ash contents, thus resulting in lower BTU values per pound. Transportation costs, therefore, tend to become a disproportionate part of the cost of BTUs at the point of use.

It is apparent, therefore, that a new system is desired to permit the use of high sulfur coals particularly those that are favorably situated in regard to points of use. It is an object of this invention to introduce such a system.

SUMMARY OF THE INVENTION

It is a well known fact that above ground gasifiers of coal, such as the Lurgi process, operate in a reducing environment and that the sulfur content of the coal is largely converted to gaseous hydrogen sulfide ($H_2S$). While maintaining a reducing environment in the confines of a Lurgi gasifier above ground is relatively simple, maintaining a reducing environment undergound heretofore has not been accomplished on a sustained commercial basis.

Hydrogen sulfide is dangerously poisonous but is easily contained in the exit gas stream from a subsurface coal formation where it can be delivered to an extraction unit. At the extraction unit, hydrogen sulfide is readily removed, by one of several commercial processes, for further processing into elemental sulfur. By burning coal in a reducing environment, sulfur content of the coal is distributed in the following typical manner: 16 to 22 percent is retained in the residue ash, 66 to 75 percent is gasified as $H_2S$, and 2 to 4 percent is gasified as organic sulfur (carbon disulfide and carbonyl sulfide). In gasification of coal in situ in accordance with the present invention, the sulfur content retained in the residue ash remains underground and the sulfur content gasified is readily scrubbed from the produced gas, yielding a residue gas that is virtually sulfur free. Thus, in situ gasification of coal may be used in coal deposits that range from low to high sulfur content.

In coal deposits that are favorably located for conventional commercial mining, unusually thick sections, for example, 20 to 100 feet thick are difficult to mine with equipment currently available. These sections can effectively be gasified in accordance with the method of the present invention.

In coal deposits that are aquifers in the coal strata, water encroachment is both a hazard and a source of significant extra cost to undergound workings. Water encroachment is readily controlled in the process of the present invention and instead of being a disadvantage, it is an advantage in maintaining a suitable reducing environment. For example, formation water can be excluded from the underground reaction zone by increasing the gas pressure to a value significantly above that of the hydraulic head. Then as water vapor is needed underground to react with incandescent coal, mine pressure is reduced in the reaction zone to permit the planned encroachment of water to support the reaction. (If the coal strata is not water bearing, the same result can be accomplished by introducing appropriate quantities of water or steam from the surface). In this reaction the water or steam is split into its components, hydrogen ($H_2$) and oxygen (O), released hydrogen is available to form methane ($CH_4$) or other gaseous hydrocarbons, and to unite with the sulfur content of the coal to form hydrogen sulfide ($H_2S$). Released oxygen is available to support combustion and to form carbon monoxide (CO).

As the reaction zone underground is brought up to optimum temperature and pressure, quantities of carbon dioxide ($CO_2$) are generated as hot exit gas. A portion of the hot $CO_2$ reacts with incandescent coal as follows:

$$CO_2 + C = 2CO$$

The carbon monoxide thus formed adds to the produced gases containing useful calorific content. Unreacted $CO_2$ continues as an exit gas where a substantial portion of its sensible heat is extracted for commercial purposes.

In coal deposits that are gas prone, the principal gas is methane ($CH_4$) which is valuable as an exit gas due to its high calorific value (approximately 1,000 BTU per standard cubic foot). Gas is a disadvantage in undergound workings but is an advantage to in situ gasification of coal in accordance with the present invention. Methane, due to its low specific gravity rises to the highest permeable point underground and thus may be produced in the unburned exit gases.

Coal deposits that are also aquifers normally have acceptable permeability for in situ gasification, otherwise the water would not be able to percolate through the strata. In those cases where permeability is lower than desired, permeability may be increased by fracturing techniques commonly used in the petroleum industry. Upon establishing a reaction zone underground, the coal is burned on the exposed face and the volatiles are driven off through the permeable channels. As the burning proceeds the fire front invades the permeable channels gradually enlarging them and temporarily bypassing large quantities of carbonized coal. After an extended period of time the coal deposit, in plan view, resembles the mud crack pattern of a dry lake, with numerous aits of columnar coal. These irregular columns serve as roof supports for the overburden and prevent extensive subsidence. As in situ burning proceeds the columns are gradually consumed, losing their support strength and resulting in reasonably uniform subsidence over the area affected. Thus by carefully planning the locations of injector-producer wells, the roof may be lowered in a reasonably uniform manner somewhat similar to planned subsidence in the long wall system of underground mining.

Individual wells used for in situ gasification of coal are subject to wide variations in the calorific content of produced gas. In the early stages of bringing the well on production, in situ combustion is commonly initiated in an oxidizing environment until a reaction zone of suitable size is established. Under these conditions large quantities of carbon dioxide are generated in the exit gases, and if air is used to support combustion, large quantities of hot nitrogen are also generated. Both gases serve to reduce the calorific content of produced gases. Until the well matures so that it can be operated in a reducing environment, calorific content of the produced gases will remain low. Further, mature wells can also have low calorific values in produced gases when the injected oxygen supply bypasses the reaction zone changing the environment from reducing to oxidizing and causing unplanned burning of the hot exit gases. While this condition can be corrected by redirection of oxygen injection, calorific content of the produced gases will fluctuate until the well is reestablished according to plan. Thus it is seen that a multiplicity of wells may be desirable with each well connected by pipeline to a central mixing point in order to unify the calorific content of the composite gases.

To assist in igniting the coal formation, the present invention utilizes a granular material which is preheated to a temperature in excess of the ignition temperature of the coal so that when the granular material is deposited in the well bore so as to come into contact with the coal, the coal can be easily ignited. Further, the granular material is preferably non combustible so that it will flow into cavities formed in the burning coal formation to serve as a propping agent in the event of subsidence of the coal formation and will thereby preserve the permeability of the formation for the continued recovery of produced gases.

Other objects, advantages and capabilities of the present invention will become more apparent as the description proceeds taken in conjunction with the accompanying drawings.

DESCRIPTION OF THE PREFERRED EMBODIMENT

Figure 1:
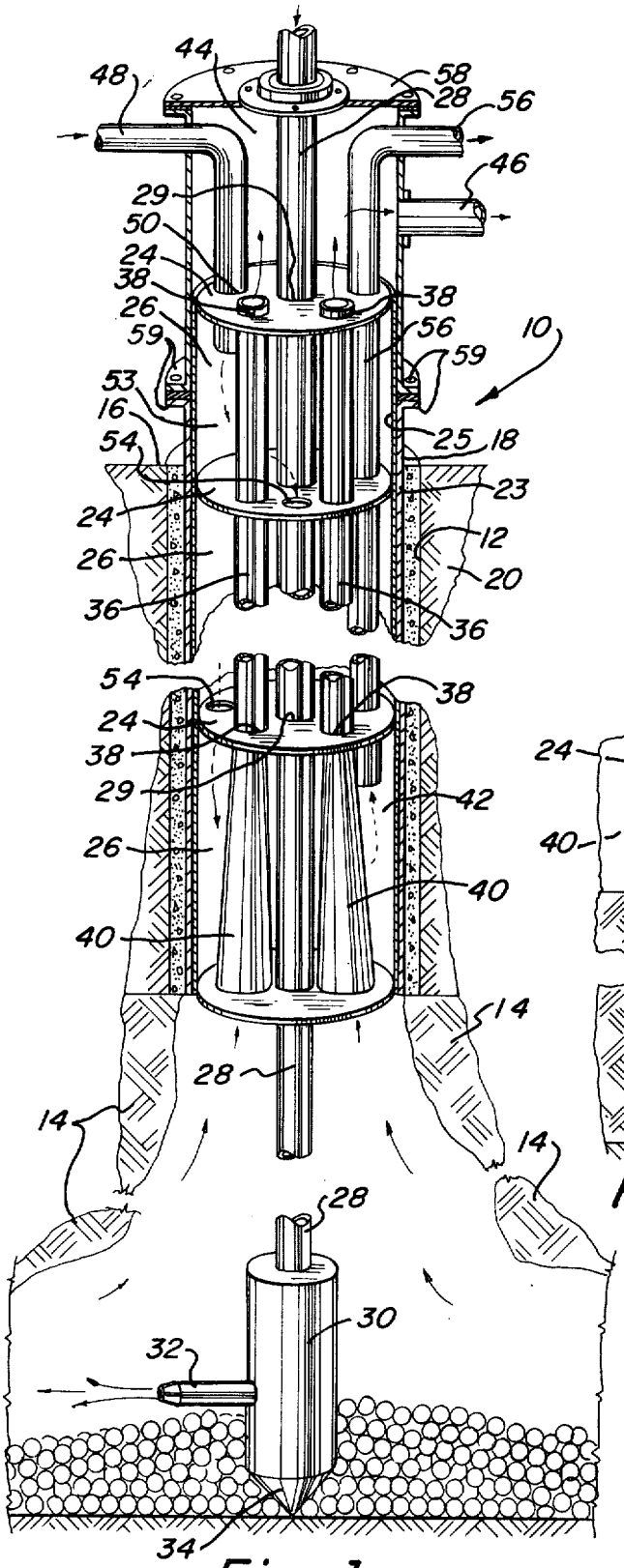
FIG. 1 is a perspective section taken through a portion of the earth and illustrating the apparatus of the present invention positioned within the well bore connecting a subsurface coal formation to a surface location.

Referring first to FIG. 1, the apparatus 10 of the present invention is shown positioned in a well bore 12 connecting a sub surface coal formation 14 to a surface location 16 of the earth. The well bore 12 which could be for example 24 inches in diameter, is drilled to the top of the coal formation and a casing 18, for example 20 inches in diameter, is set and cemented into place to seal off the strata in the overburden 20. After the casing is set, the well bore is extended at 22 (FIGS. 3A and 3B), for example sixteen inches in diameter, to the bottom of the coal formation.

A heat extraction unit 23 is installable in the casing 18 and includes a plurality of disc-like divider plates 24 which are circular in configuration to conform to the inner wall of a liner 25 and are fixed in the liner at vertically spaced locations so as to divide the liner into a plurality of vertically aligned compartments 26. Each of the disc like divider plates 24 has a plurality of circular apertures therethrough for a purpose to be described hereinafter. A gas injection conduit 28 extends vertically through the well bores 12 and 22 and passes through aligned apertures 29 in the divider plates in its descent through the well bore and is connected at its lower end to a whip stock 30 having a laterally directed outlet nozzle 32 through which injected agents can be emitted in selected directions. In the disclosed form, the whip stock 30 has a conical lower end 34 which allows the whip stock to pivot about the longitudinal axis of the injection conduit whereby the outlet nozzle 32 can be pointed in any desired direction within the coal formation. As will become more fully appreciated later, the injection conduit is utilized for the injection of oxidizing agents to maintain desired burning conditions in the coal formation.

Figure 2:
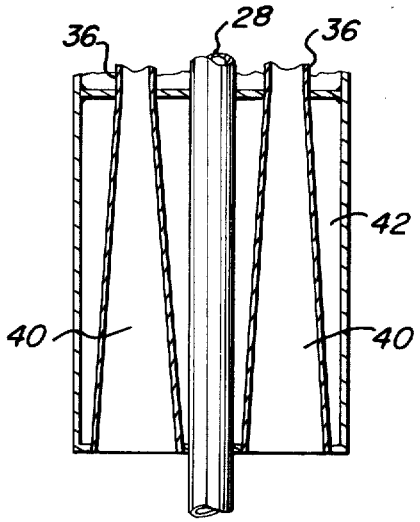
FIG. 2 is an enlarged vertical section taken through a super heater device forming a portion of the apparatus shown in FIG. 1.

A plurality of gas exit conduits 36 (two of which are shown) also pass vertically through the well bore 12 and through aligned apertures 38 in the divider plates 24. Each gas exit conduit 36 has a frustoconical lower end 40, FIGS. 1 and 2, which passes through the lowermost compartment 42 of the plurality of vertically aligned compartments 26 defined by the divider plates. The frustoconical lower ends of the gas exit conduits increase the surface area of the conduits 36 for heat transfer purposes as will become more apparent later. The lower compartment 42 of the apparatus will be referred to as a super heater in that the heat transfer taking place in this compartment is greater than in any of the other vertically aligned compartments. The upper ends of the gas exit conduits 36 open into the uppermost compartment 44 in the apparatus and a gas outlet tube 46 communicates with this compartment for the removal of the produced gases which have risen through the gas exit conduits as a result of the burning coal formation.

The apparatus illustrated and described has been designed primarily to extract sensible heat from the produced gases so that this heat can be used apart from the produced gas to produce useful energy. In effecting this capture of the sensible heat in the produced gases, a heat receptive fluid, such as water, steam, oxygen enriched air or the like, is introduced into the heat extraction unit 23 through an inlet pipe 48 and is allowed to flow downwardly through the successive compartments 26 defined by the divider plates 24 so that the water is exposed and completely surrounds the hot gas exit conduits 36 to extract the heat from the gas flowing through the conduits. As illustrated in FIG. 1, the inlet pipe 48 for the water passes downwardly through an opening 50 in the uppermost divider plate so that water being introduced into the system is deposited into the next to the top compartment 53. Open apertures 54 are provided in each successive divider plate so that the water can flow through the aperture into the next lower compartment. As will be appreciated, the apertures 54 are positioned so that they are not in vertical alignment whereby water passing from one compartment to the other must circulate at least to a limited extent to pass through the aperture in the lower divider plate of the compartment before passing through to the next lower compartment. When the water reaches the super heater compartment 42 of the apparatus, which is the lowest compartment of the apparatus, it is allowed to circulate around the frustoconical lower ends 40 of the gas exit conduits 36 to strip sensible heat from the gas flowing through these conduits. If the temperature in the super heater is above the vaporization temperature of the water at the prevailing pressure, it will flash to steam and rise through a removal conduit 56 which has its lower end opening into the super heater compartment 42 and its upper end extending out of the apparatus at the surface location 16. If the temperature in the super heater is below the vaporization temperature of the water at the prevailing pressure, the pressure of the liquid being injected into the system is maintained at a level such that the hot water will rise through the removal conduit 56 and thereby be removed from the apparatus as a hot liquid or steam if it flashes to steam at or near the surface location where the pressure is lower than that at the super heater or if it is circulated at a rate sufficient to generate steam. The heat from the liquid of course can be used in any conventionally known manner to generate electricity or other forms of energy.

A christmas tree assembly 58 is hermetically sealed and connected to the upper end of the casing 18 by flanges 59 on the christmas tree assembly and the casing so that the pressure within the casing and the coal formation can be controlled and the injection and removal of the gasifying agents, heat transfer fluids, and produced gases can be controlled for optimum operating conditions.

Figure 3A:
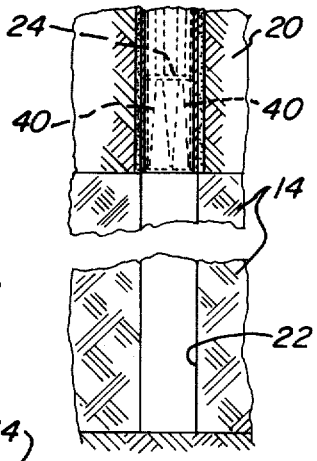
FIGS. 3A through 3C are diagrammatic operational views illustrating the use of hot granular material in igniting a coal formation and retaining permeability in the formation.
Figure 3B:
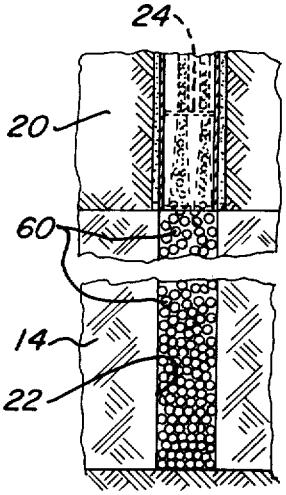
Figure 3C:
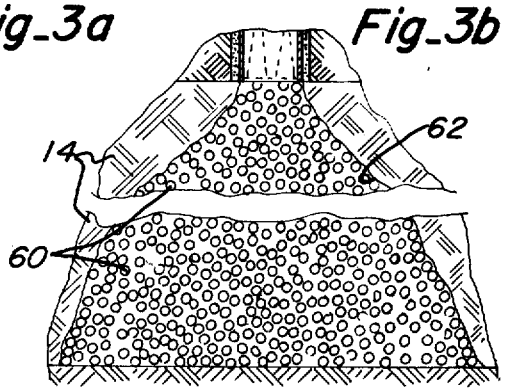

Referring to FIGS. 3A through 3C, it will be seen in FIG. 3B that a granular material 60 is filled in the open well bore 22 (FIG. 3A) which extends through the coal formation prior to ignition of the coal bed. This granular material could be gravel, ceramic balls, or another suitable material which can be raised above the ignition temperature of coal, for example, 800° F, so that the granular material 60 when it lies in contact with the coal will ignite the coal to begin the in situ gasification process to be described in detail latar. As will be appreciated in FIG. 3C, as the formation begins to burn a cavity 62 forms as an enlargement of the initial well bore 22 and the granular material flows into the cavity. The granular material will continue to flow outwardly into the cavity until it has obtained its angle of repose and will thereafter serve as a propping agent in the event of a cave-in or collapse of the coal formation to thereby serve to retain permeability in the formation to allow the produced gas to flow through the granular material for recovery through the casing 18. Charcoal briquettes could be used as the granular material to ignite the coal but, or course, after they have burned they would not be useful as a propping agent.

In the practice of the method of the present invention, extremely hot granular material 60 is poured into the gas exit conduits 36 in a non-flammable environment so as to flow into the coal formation until the well bore 22 through the coal formation is filled with the granular material. More granular material 60 at ambient temperature is added until the gas exit tubes 36 are filled with the material. An oxidizing agent, for example oxygen enriched air, is then injected through the injection conduit 28 at an appropriate pressure, for example 250° psig, to drive the formation water away from the well bore 22. Heat transferred from the granular material 60 will increase the temperature of the exposed coal above its ignition temperature, for example 800° F, at which point the exposed coal ignites and the in situ combustion process begins. The oxidizing agent is injected at the bottom of the coal bed, and the injection line 28 is rotated, for example 60°, at appropriate intervals, for example four hours. A reaction zone will be formed at the bottom of the coal bed as burning proceeds.

As mentioned previously, the granular material 60 will slowly settle into the reaction zone until the material has reached the angle of repose. The material around the well bore serves as a highly permeable propping agent to assure gas flow into the well bore in the event of unplanned subsidence or spalling of the overburden 20 in the vicinity of the well bore.

Oxidizer injections continue until a suitable reaction zone, for example 1,000 cubic feet, is established. The mine pressure is then dropped by reducing oxidizer injection pressure to near equilibrium with the hydrostatic head pressure, for example 75 psig. Formation water may be excluded from the reaction zone by keeping the mine pressure above the hydrostatic head pressure or formation water may be permitted to encroach by reducing the mine pressure below the hydrostatic head pressure. The pressure adjustments are made in accordance with a plan for the content of the produced gas.

The rotation of the oxidizer injection line 28 is continued, until a physical obstruction underground bars further rotation. In accordance with the disclosure in my copening application Ser. No. 510,409 the injection line can be a flexible line so as to be extensible away from the initial well bore 22 and in the event that a system of this type is used, the injection line is manipulated to extend further and further into the reaction zone away from the well bore to form underground tunnels. Injection into the tunnels continues until the planned length of the tunnels is reached. By reworking the well other tunnels can be created until the area of influence has tunnels radiating from the well bore like spokes of a wheel.

The apparatus 10 of the invention which is situated in the well bore 12 serves as a heat exchanger and as mentioned previously provides means for circulating heat receptive fluid, such as water downwardly from the surface to the bottom of the apparatus and subsequently back to the surface through the removal conduit 56. The apparatus has two purposes, with the primary purpose being to strip sensible heat from the exit gases and transfer the stripped heat in the form of steam to an electrical generating plant or the like. The secondary purpose is to move heat away from the well casing 18 so that the well casing does not overheat and lose its strength. Produced gases enter the well bore generally around 2,000° F. The divider plates 24 in addition to controlling the heat transfer liquid flow, serve to prevent surges of superheated steam at the bottom of the apparatus from hammering to the top of the column, and to minimize both vibration and localized hot spots. The inlet water is injected at the top of the apparatus and the super heated water or steam is removed from the bottom of the apparatus through the removal conduit 56. Circulation rates for the water are controlled so that exit gas temperature at the well head, for example 500° F, remains above the dew point of the produced gas. Keeping exit gases above the dew point is particularly important when the well is operating in an oxidizing environment, because produced gaseous sulfuric acid should not be permitted to condense until it reaches a proper point in the surface facilities.

As mentioned previously, the water is directed to the lowermost chamber 42 of the apparatus which functions as a super heater where the maximum temperature of the exit gases is encountered. Compared to the chambers above, a much larger heat transfer surface area is provided to facilitate the transfer of sensible heat from the exit gases to the circulating water. The return conduit 56 to the surface is insulated so that minimum heat losses occur.

After the reaction zone is established at the bottom of the coal bed, oxidizer injection is adjusted for a starved oxygen environment so that incomplete combustion occurs. A coal face along a reaction zone will burn and release large quantities of carbon monoxide. Coal located adjacent to the burning face will be heated and will give up its volatile content which is drawn off in the exit gases as high calorific components of the exit gases. Moisture content of the coal will be flashed to steam which, in turn, reacts to form blue gas. Methane in the immediate vicinity of the reaction zone will be driven off into the exit gases. Adjacent coal after giving up its volatile content becomes carbonized and will itself burn as the fire front reaches it. By controlling the location of the oxidizer injected, virtually all of the coal in place can be burned to ash residue.

In following the steps described above, initially an oxidizing environment is established which results in low BTU gas in the order to approximately 100 BTU per standard cubic foot. In the next steps, the environment is changed to reducing and the calorific content of the gas improves markedly to levels in the order of 500 to 700 BTUs per standard cubic foot. It is during this period that entrained methane is driven off, volatile content is gasified and the blue gas is formed. As the methane and volatile content approaches depletion in the area of influence of the well, calorific content of the produced gases begins to decline. The moisture content of the coal serves as a limit to the amount of blue gas that can be formed, which is substantially below the amount of blue gas that can be produced when additional steam is added to the reaction zone.

In the preferred embodiment of the instant invention, extra steam is introduced into the reaction zone when the calorific content of the produced gas drops below a planned level, for example 500 BTU per standard cubic foot. This is accomplished by reducing the mine pressure in an individual well for a planned period of time, for example one hour, to permit encroachment water to enter the hot zone and flash to steam. This is followed by a build up of pressure by oxidizer injection to the planned mine operating pressure, for example substantially in equilibrium with hydrostatic head pressure, and continuing for a planned period of time, for example, four hours. The amount of time for normal pressurized operation will depend upon the permeability of the coal strata and the amount of formation water available for encroachment. In cases where encroachment is too slow or water available is insufficient, steam or water from surface facilities can be injected through the oxidizer injection line.

Preferably, a plurality of wells, for example, ten rows of ten wells each are established in the coal formation. The operation of the wells is staggered so that certain of the wells are receiving water while the other wells are operating at a higher pressure excluding water. The particular geometric pattern of wells is established with due regard to the underground water flow characteristic of the coal strata. Such an arrangement using oxygen enriched air, will permit the generation of produced gas with a calorific content in the order of 300 BTU per standard cubic feet or higher until the coal deposit is substantially depleted. Of course, the wells can be interconnected by suitable insulated pipeline gathering systems with one system recovering the hot water or steam and transporting the hot water or steam into an electric generating plant or the like and the other system transporting the produced gases to a central point where particulate matter can be removed, where hydrogen sulfide is removed and where water vapor and other gasified liquids are removed. The resultant dry gas can be directed by pipeline to either gas storage facilities or directly to the power plant of an electric generating station.

Although the present invention has been described with a certain degree of particularity, it is understood that the present disclosure has been made by way of example and that changes in details of structure may be made without departing from the spirit thereof.

What is claimed is:

1. Apparatus for in situ gasification of a subsurface coal formation which is in communication with a surface location by an open passage comprising in combination:

a casing in said passage, said casing having divider means defning vertically aligned compartments in said casing, each of said divider means, with the exception of the uppermost and lowermost ones of said divider means, having openings therethrough establishing fluid communication between adjacent compartments defined between said uppermost and lowermost divider means for the passage of fluid material between adjacent compartments, injection conduit means extending from said surface location to the coal formation, gas removal conduit means extending from the coal formation to the surface location, said gas removal conduit means passing through said compartments in the casing, fluid inlet means for introducing a heat receptive fluid into the uppermost one of said compartments whereby said heat receptive fluid can flow downwardly through successive compartments to strip sensible heat from the gases passing through said gas removal conduit means, and fluid removal means for transferring the heat receptive fluid from the lower end of the casing to the surface location where the heat in the fluid can be removed for useful purposes.

2. The apparatus of claim 1 further including a liner in said casing to which said divider means are affixed, said liner defining the walls of said compartments whereby said heat receptive fluid will be in contact with the liner to assist in removing heat from the casing.

3. The apparatus of claim 2 wherein said divider means are in the form of plate-like discs secured to the inner wall of the liner at vertically spaced intervals.

4. The apparatus of claim 1 wherein said injection conduit is flexible whereby it can be selectively directed in any desired direction in the coal formation to deliver oxidizing agents to selected locations in the coal formation.

5. The apparatus of claim 1 further including means in a lowermost one of ssaid compartments to effect a greater heat transfer in that compartment than in the other of said compartments.

6. The apparatus of claim 5 wherein said super heater includes a hollow chamber through which the heat receptive fluid flows and through which gas exit conduit members pass, said gas exit conduit members being in fluid communication with the gas removal conduit means and exposing a large surface area per vertical unit of distance to effect optimum heat transfer from the exit gases to the heat receptive fluid.

7. A method of in situ gasification of a subsurface coal formation comprising the steps of:

establishing a passage between a surface location and the coal formation, setting a casing in the passage, injecting a plurality of hot particles in a non-flammable environment into said casing, said particles having a temperature in excess of the ignition temperature of coal, and allowing at least some of the particles to come into contact with the coal to ignite the coal causing it to burn and give off useful gases.

8. The method of claim 7 wherein the particles are made of a rigid substance and further including the step of allowing the particles to move ito cavities formed in the burning coal formation to serve as a propping agent in the event of a cave-in.

9. The method of claim 7 further including the steps of positioning a gas injection conduit in the casing to inject oxidizing gases into the formation and positioning a gas removal conduit in the casing to remove produced gases from the formation.

10. The method of claim 9 wherein said particles are ceramic balls and the balls are positioned within the gas removal conduit.

11. A method of in situ gasification of a subsurface coal formation comprising the steps of:

establishing a passage between a surface location and the coal formation, setting a casing in the passage, placing a plurality of rigid particles in the casing, igniting the coal formation, and allowing the rigid particles to move into cavities formed in the burning coal formation to serve as a propping agent in the event of a cave-in.

12. A method of in situ gasification of a subsurface coal formation comprising the steps of:

establishing a passage between a surface location and the coal formation, setting a casing in the passage, providing a plurality of dividers in the casing separating the casing into a plurality of vertically aligned compartments, each of said dividers having an opening therein to provide fluid communication between the compartments, positioning an injection conduit in the casing for injecting gasifying agents into the coal formation, positioning gas removal conduits in the casing to remove produced gases from the coal formation, said removal conduits being positioned so as to pass through the compartments in the casing, positioning a fluid removal conduit in the casing to transfer fluids from a compartment adjacent to the lower end of the casing to the surface location, igniting the coal formation so as to produce hot gases which are transferred to the surface location through the gas removal conduits, and circulating a heat receptive fluid downwardly through said compartments and upwardly through said fluid removal conduit to effect a heat transfer from the produced gas to the heat receptive fluid.

13. The method of claim 12 further including the step of passing the heat receptive fluid through a super heater adjacent to the lower end of the casing prior to transferring the fluid through the fluid removal conduit.

14. The method of claim 12 wherein the fluid is water.

15. The method of claim 14 wherein the fluid is circulated at a rate to generate steam.

16. The method of claim 12 wherein the fluid is steam.

17. The method of claim 12 wherein the fluid is oxygen.

18. The method of claim 12 wherein the fluid is oxygen enriched air.

19. The method of claim 12 wherein the coal formation is ignited by placing a plurality of hot particles in the casing so that they are in contact with the coal formation, said particles having a temperature in excess of the ignition temperature of the coal.

20. The method of claim 19 wherein said particles are ceramic balls.

21. The method of claim 19 wherein said particles are charcoal briquettes.

22. The method of claim 19 further including the step of allowing the particles to move into hollow cavities formed during the burning of the coal formation.

23. The method of claim 12 further including the step of raising the pressure in the coal formation to above the hydrostatic head pressure to expel water from the formation when desired.

24. The method of claim 12 further including the steps of alternately raising and lowering the pressure in the coal formation above and below the hydrostatic water head to alternately prevent and allow water into the formation to optimize the generation of blue gas.

25. A method of in situ gasification of a subsurface coal formation comprising the steps of:

establishing a passage between a surface location and the coal formation, setting a casing in the passage, establishing an hermetic seal between the coal formation and the surface location, igniting the coal formation, burning the coal in situ to form and maintain a reaction zone, injecting an oxidizing agent into the coal formation while alternately adjusting the quantity, quality and pressure of the injected oxidizer to alternately establish an oxidizing and reducing environment in the coal formation, and withdrawing the produced gases from the coal formation and delivering them to the surface location.

* * * * *